United States Patent [19]

Fisher, Jr.

[11] Patent Number: 4,595,930

[45] Date of Patent: Jun. 17, 1986

[54] PLANAR LOG PERIODIC QUAD ARRAY

[76] Inventor: James W. Fisher, Jr., Rd. 1, Box 424, Emmaus, Pa. 18049

[21] Appl. No.: 633,308

[22] Filed: Jul. 23, 1984

[51] Int. Cl.[4] ..... H01Q 11/10

[52] U.S. Cl. ..... 343/792.5

[58] Field of Search ..... 343/792.5, 740–743, 343/732, 733, 905, 908

[56] References Cited

U.S. PATENT DOCUMENTS 3,202,996 8/1965 Tanner ..... 343/792.5

OTHER PUBLICATIONS

Fisher, "A Log-Periodic Quad Array", *CQ*, Feb. 1977, vol. 33, No. 2, pp. 48–51, 72–73.

*Primary Examiner*—Eli Lieberman
*Assistant Examiner*—Michael C. Wimer
*Attorney, Agent, or Firm*—Stephenson & Boller

[57] ABSTRACT

A planar log periodic quad array comprising a two-conductor twisted transmission line to which log periodic elements are connected. The elements are arranged in two sets on opposite sides of the transmission line and are in a common plane. Each element has two points of connection with a particular conductor of the transmission line and comprises two sides each extending from a respective one of the two points of connection to the particular conductor to join at a corner which lies on an imaginary line perpendicular to the transmission line at its center feed point. Immediately adjacent elements of one set are connected to alternate ones of the two conductors of the transmission line and each element of the other set has a general geometric symmetry about the transmission line with respect to a corresponding element of the one set but with its points of connection to the transmission line being to the opposite conductor. The array is suited for active or passive use and has a broadband characteristic.

2 Claims, 2 Drawing Figures

PLANAR LOG PERIODIC QUAD ARRAY

BACKGROUND AND SUMMARY OF INVENTION

This invention relates generally to antennas and more specifically to a new and improved array, particularly to a planar log periodic quad array.

Log periodic dipole arrays (LPDA's), including the hybrid log periodic yagi (LPY) are well known to radio amateurs. Perhaps less well known to radio amateurs are log periodic quad arrays (LPQA's).

The basic theory of a conventional log periodic array (LPA) is that the array is balanced with elements on one bay offset by equally long opposing elements on the opposite bay and with the two bays being fed 180° out of phase through single conductor feed line booms. The log periodic arrangement of the elements provides a uniform gain over a wide frequency range by progressively scaling down the spacing distance between adjacent elements by a constant multiplier, such as 0.9 for example. Because the two bays aim forward as opposed to being in the same plane the array has a front-to-back ratio in the direction of the smaller elements.

An LPDA can be derived from the basic LPA if the two bays are moved together and the booms made very close or in fact replaced by a two wire balanced transmission line twisted between each set of elements. The LPDA has a gain in the direction of the smaller elements also giving it a front-to-back ratio.

An LPQA can be derived from an LPDA by replacing each dipole with a loop (quad element) resonant at the same frequency. While a full wave loop has several db gain over a dipole it would seem that such an LPQA should have an improvement over the LPDA. It has been found however that while such an antenna may perform well over a limited frequency range it has other deficiencies that can be identified through application of either quad or log periodic theory. For example, at most one loop is exactly a full wave with the others being progressively larger or smaller. The resultant current maxima in the other loops are not distributed in a symmetrical manner about a single central plane, the current patterns do not contribute efficiently toward a single pattern of forward gain, and the resistance and reactance patterns at the feed point may show significant excursions.

An improved form of LPQA is disclosed in U.S. Pat. No. 3,273,159.

The present invention is an outgrowth of attempts to further improve upon an LPQA and it results in an array having particular advantages over other arrays. Moreover, it has the potential for use as either an active or passive part of an antenna. When operating actively it provides a bi-directional pattern characterized by gain over a dipole.

Moreover it has a broadband capability which makes it especially well suited for use with expanded frequency ranges which have recently been authorized by the Federal Communications Commission for amateur radio usage. Although amateur radio usage is one application of the invention, principles of the invention may be more broadly applied.

For example when the array is used as a passive part in a larger antenna it can be used to modify or enhance the basic characteristics of the antenna, for example by imparting particular directional characteristics to the antenna. When used as an active element, an array embodying principles of the invention offers gain over a conventional dipole and it also affords broadband coverage with a single feed line. Various embodiments of the invention may use various scaling factors for the log periodic aspect, for example a range of log periodic scaling from 0.7 to 0.9 is a typical range with in which a particular scaling factor for any given array may be selected.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
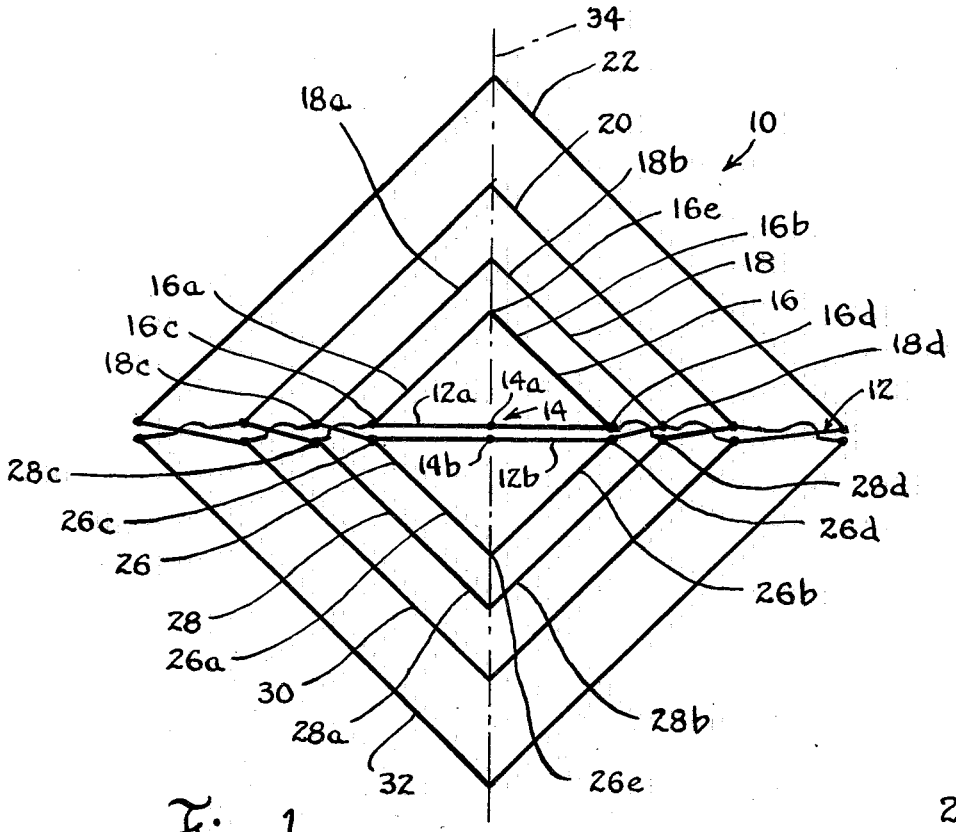
FIG. 1 is a front elevational view of an array embodying principles of the invention and is of a semischematic nature.
Figure 2:
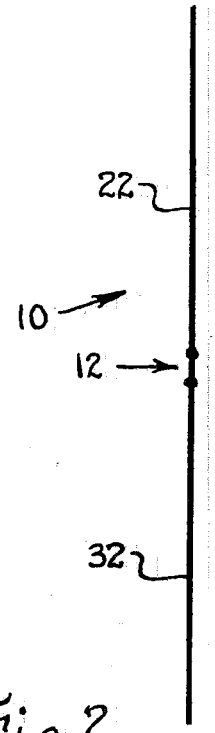
FIG. 2 is a right side elevational view of the array of FIG. 1.

FIGS. 1 and 2 illustrate a planar broadband log periodic quad array (PLPQA) 10 embodying principles of the present invention. While array 10 will be described as being an active element, it will be appreciated that the array can be put to use as a passive element as well. Moreover it will be appreciated that array 10 may constitute the entire antenna array for any given array, or it may form one part of a larger, more complex array.

Array 10 comprises a two-conductor twisted transmission line 12 having individual conductors 12*a* and 12*b*. Transmission line 12 extends in opposite directions from a center feed point 14 which consists of two feed points 14*a* and 14*b* respectively for the two conductors 12*a* and 12*b*. Thus the transmission line has equal lengths on opposite sides of feed point 14.

Associated with transmission line 12 on one side are a set of four conductive elements designated by the reference numerals 16, 18, 20 and 22 respectively. On the opposite side of the transmission line are four additional conductive elements 26, 28, 30 and 32. As can be seen, all elements 16, 18, 20, 22, 26, 28, 30 and 32 lie in a common plane, which also contains transmission line 12.

Elements 16, 18, 20 and 22 may be considered to constitute a first set and elements 26, 28, 30 and 32 a second set for purposes of convenience in describing the disclosed embodiment of the invention. The spacing distance between the elements of each set is in accordance with a chosen log periodic scaling factor, and by example the drawing depicts a factor of 0.7. It can be seen that each of the individual elements has a similar shape comprising two sides extending from points of connection to a particular one of the transmission line conductors 12*a*, 12*b*.

Thus in the case of element 16, that element comprises two sides 16*a*, 16*b* which extend from respective points of connection 16*c* and 16*d* to conductor 12*a*.

Element 26 is essentially the mirror-image of element 16 comprising sides 26*a*, 26*b* but having points of connection 26*c* and 26*d* to conductor 12*b* instead of conductor 12*a*.

Element 18 comprises sides 18*a* and 18*b* which have respective points of connection 18*c* and 18*d*, not to conductor 12*a*, but rather to conductor 12*b*.

Element 28 has sides 28*a* and 28*b* with points of connection to 28*c* and 28*d* to conductor 12*a*.

As can be seen from consideration of FIG. 1 this pattern repeats wherein the immediately adjacent elements on one side of the transmission line connect to alternate conductors of the two-conductor twisted transmission line, and similarly for the other side of the array. But the corresponding elements which are opposite each other in the array connect to opposite ones of the two conductors of the transmission line.

While the illustrated example shows a total of eight such elements, it will be appreciated that this is merely exemplary, as is the chosen log periodic scaling factor.

It will be observed that each of the elements has its two sides joining at a corner point, 16*e* and 26*e* in the case of elements 16 and 26. These corner points lie on an imaginary line 34 which is perpendicular to transmission line 12 at feed point 14. The illustrated embodiment shows the sides of the elements to be swept at essentially 45° to the transmission line whereby the sides of each element join at the corresponding corner in essentially a right angle. Thus the corresponding elements on opposite sides of the transmission line have essentially a square configuration. It will be appreciated however that departures from this illustrated configuration may be made while still employing principles of the present invention, The particular manner for fabricating an array embodying principles of the invention may be accomplished using any of conventional techniques. For amateur radio use, the elements may be constructed of wire supported in any suitable manner.

Moreover, it is possible to associate conventional electrical components with the array in order to tune or enhance particular characteristics. For example, connection of an appropriate reactance across points 14*a*, 14*b* may improve the array's impedance characteristic.

The array has the advantages of being bi-directional and broadband, and as noted above it can be put to either active or passive uses. It has potential uses as a director, a reflector, or a sink in a more complex array. It is also usable by itself as a very compact antenna offering gain over a dipole and broadband coverage with a single feed line. The actual size of any given array and the number of its elements will depend upon the frequency ranges of interest.

While a preferred embodiment of the invention has been disclosed, it will be appreciated that principles are applicable to other embodiments.

What is claimed is:

1. A broadband array comprising a twisted two-conductor transmission line extending in opposite directions from a center feed point and a plurality of conductor elements arranged in log periodic manner along the transmission line, said elements being arranged in two sets with one set lying substantially in a plane on one side of the transmission line and the other set lying substantially in the same plane on the opposite side of the transmission line, any given element in said one set having two points of connection with a particular conductor of the transmission line and comprising two sides each extending from a respective corresponding one of the two points of connection to the particular conductor to join at a corner which lies on an imaginary line perpendicular to the transmission line at the center feed point, immediately adjacent elements of said one set being connected to alternate ones of said two conductors of said line, and each element of said other set having generally geometric symmetry about the transmission line with respect to a corresponding element of said one set but with its points of connection to the transmission line being to the opposite conductor.

2. An array as set forth in claim 1 wherein each element of said one set and the corresponding element of the other set are arranged in a generally square shape.

* * * * *